US009403661B2

(12) United States Patent
Watkins

(10) Patent No.: US 9,403,661 B2
(45) Date of Patent: Aug. 2, 2016

(54) COLLAPSIBLE REEL

(71) Applicant: Sonoco Development, Inc., Hartsville, SC (US)

(72) Inventor: Eric Watkins, Lugoff, SC (US)

(73) Assignee: Sonoco Development, Inc., Hartsville, SC (US)

( * ) Notice: Subject to any disclaimer, the term of this patent is extended or adjusted under 35 U.S.C. 154(b) by 335 days.

(21) Appl. No.: 14/248,841

(22) Filed: Apr. 9, 2014

(65) Prior Publication Data

US 2015/0291386 A1 Oct. 15, 2015

(51) Int. Cl.
*B65H 75/22* (2006.01)
*B65H 75/14* (2006.01)

(52) U.S. Cl.
CPC ..... *B65H 75/22* (2013.01); *B65H 75/14* (2013.01)

(58) Field of Classification Search
CPC ..... B65H 75/22
USPC ..... 242/608, 608.2, 608.3, 608.4, 242/118.6–118.62
See application file for complete search history.

(56) References Cited

U.S. PATENT DOCUMENTS

| | | | | | |
|---|---|---|---|---|---|
| 3,614,018 | A * | 10/1971 | Jones | B65H 75/14 | 242/118.61 |
| 3,650,494 | A * | 3/1972 | Hutchinson | B65H 75/14 | 242/118.61 |
| 4,739,945 | A * | 4/1988 | Yokoe | B65H 75/08 | 242/118.41 |
| 5,605,305 | A | 2/1997 | Picton | | |
| 5,806,788 | A * | 9/1998 | Witwer | B65H 75/22 | 242/118.6 |
| 8,608,102 | B2 | 12/2013 | Brennaman | | |
| 2006/0102772 | A1 | 5/2006 | Davis et al. | | |
| 2008/0245920 | A1 * | 10/2008 | Houen | B65H 75/22 | 242/407.1 |

FOREIGN PATENT DOCUMENTS

| | | | | |
|---|---|---|---|---|
| FR | 2630421 A1 * | 10/1989 | B65D 85/04 | |
| FR | WO 2008132416 A1 * | 11/2008 | B65H 75/22 | |

* cited by examiner

*Primary Examiner* — William E Dondero
(74) *Attorney, Agent, or Firm* — Miller, Matthias & Hull LLP

(57) ABSTRACT

A collapsible reel that can be broken down into smaller components for ease of shipping or to change out the drum is provided. The reel comprises a drum assembly, a pair of flanges and a pair of coupling assemblies for removably affixing each flange to the drum assembly.

10 Claims, 2 Drawing Sheets

COLLAPSIBLE REEL

BACKGROUND OF THE INVENTION

1. Field of the Invention

This invention patent relates to reel for winding strand or sheet-like materials. More particularly, this invention relates to a collapsible reel that can be broken down into smaller components for ease of shipping or to change out the drum.

2. Description of the Related Art

Reels are used to hold and transport cable wound products, including wire and other strand-like materials as well as film, fabric and other sheet-like materials. Current welded reels take up a lot of space during shipment, and the traverse (flange-to-flange) and drum diameter dimensions cannot be modified without destructive re-fabrication.

A reel is needed that can be broken down into smaller components (collapsed) for ease of shipping to, for example, a strand or sheet manufacturing facility. The components must be quick and easy to assemble and disassemble. Preferably the reel has a removable drum such that the traverse and drum dimensions can be modified by replacing the drum with one of different dimensions. Such a reel would prevent an owner or operator from having to purchase entire reels when only the drum needs to be changed.

The present invention is designed to address the challenges described above.

BRIEF SUMMARY OF THE INVENTION

The present invention is a collapsible reel that can be broken down into smaller components for ease of shipping or to change out the drum.

In one aspect the reel comprises a drum assembly, a pair of flanges and a pair of coupling assemblies for removably affixing each flange to the drum assembly.

The drum assembly may comprise a drum having opposing ends and an inner diameter and configured to receive wound product. The drum assembly may also comprise a drum plate affixed to each end and having a central opening therein.

Each flange may comprise a flange center ring having a diameter slightly smaller than the inner diameter of the drum so that the flange center ring can slide within the drum, spokes extending radially outward from the flange center ring and having distal ends, and a rim affixed to the distal ends of the spokes.

Each coupling assembly may comprise at least one block affixed to the drum plate and sized to fit between adjacent spokes, a locking plate that fits over the flange center ring, and fasteners that affix the locking plate to the one or more blocks.

There may be any number of blocks. Preferably the blocks are substantially equally circumferentially spaced apart on the drum plate and welded or otherwise affixed thereto. Each block may define a threaded bore for receiving a fastener.

Each locking plate may define fastener openings in substantial axial alignment with the threaded bores and configured to receive the fasteners.

Each block may be wedged between a pair of adjacent spokes to help prevent rotational movement of the flanges with respect to the drum assembly. For example, each block may have non-parallel angular sides that abut the spokes.

In another aspect of the invention a method of assembling a reel is provided. The method may comprise the following steps:

Step 100: Providing a drum assembly comprising a substantially cylindrical drum having an inner diameter and opposing ends and a drum plate affixed to each opposing end and having a central opening therein;

Step 102: Providing two flanges, each flange comprising a substantially cylindrical flange center ring having an outer diameter slightly smaller than the inner diameter of the central opening, spokes extending radially outward from the flange center ring and having distal ends, and a rim affixed to the distal ends of the spokes;

Step 104: Providing two coupling assemblies, each coupling assembly comprising a plurality of circumferentially spaced apart blocks affixed to one of the respective drum plates, a locking plate and fasteners;

Step 106: Sliding each flange center ring within the drum so that each block fits between adjacent spokes;

Step 108: Sliding each locking plate over one of the respective flange center rings until the locking plate abuts the spokes; and Step 110: Attaching each locking plate to the plurality of blocks using the fasteners.

DETAILED DESCRIPTION OF THE INVENTION

Figure 1:
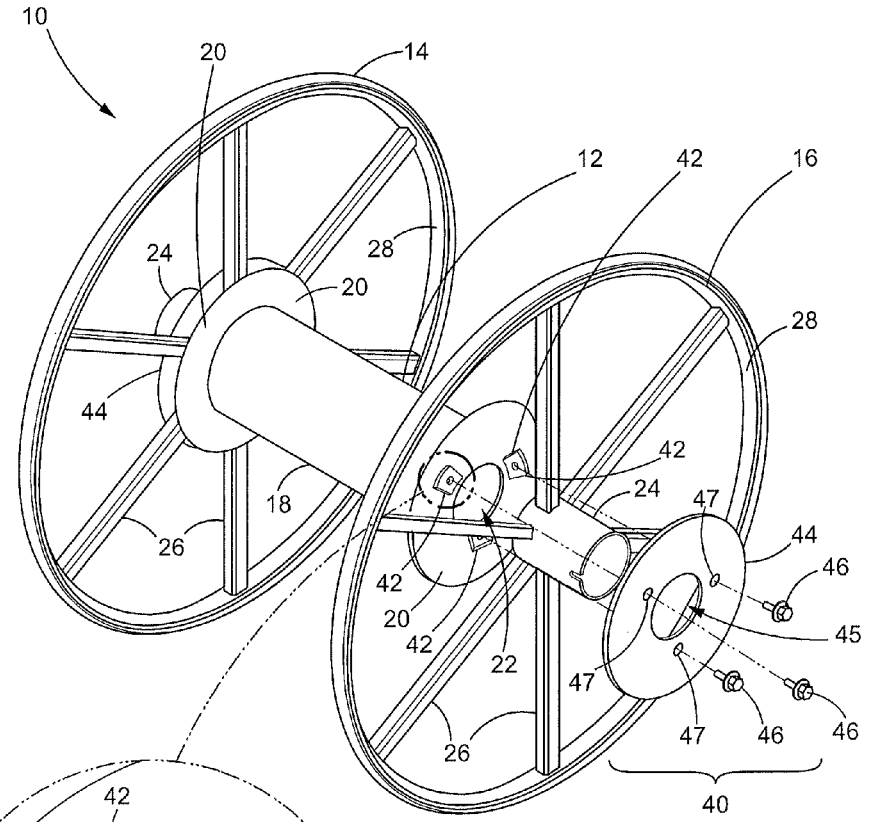
FIG. 1 is perspective view of a reel according to the invention.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Turning to the drawings, there is shown in FIG. 1 a perspective view of a reel 10 according to an embodiment of the invention. The reel 10 is a three piece assembly comprising a drum assembly 12 and a pair of flanges 14, 16. A coupling assembly 40 is used to attach each flange 14, 16 to the drum assembly 12.

The drum assembly 12 may comprise a drum 18 and drum plates 20. The drum 18 may be cylindrical, have an inner diameter and an outer diameter, and define a central axis extending in the traverse (flange-to-flange) direction. The drum 18 is configured to receive wound product. The drum plates 20 are affixed to each end of the drum 18 and have a central opening 22 therein for receiving a flange center ring 24.

Each flange comprises a flange center ring 24, spokes 26 and a rim 28. The flange center ring 24 has an outer diameter slightly smaller than the inner diameter of the drum 18 so that the flange center ring 24 can slide within the drum 18. The spokes 26 extend radially outward from the flange center ring 24 and have distal ends. The rim 28 is affixed to the distal ends of the spokes 26.

The coupling assembly 40 is used to removably attach each flange 14, 16 to the drum assembly 12. The coupling assembly 40 may comprise at least one and preferably three equally circumferentially spaced apart blocks 42, a locking plate 44, and fasteners 46 such as bolts. The blocks 42 may be welded or otherwise affixed to the drum plate 20 and are sized to fit between adjacent spokes 26. The locking plate 44 has a central aperture 45 having a diameter slightly greater than that of the flange center ring 24 so that the locking plate 44 can slide over the flange center ring 24. The locking plate 44 then can be attached to the blocks 42 with the fasteners 46. In the assembled reel 10 each flange 14, 16 is captured between a drum plate 20 and a locking plate 44 and held there by the fasteners 46.

Figure 1A:
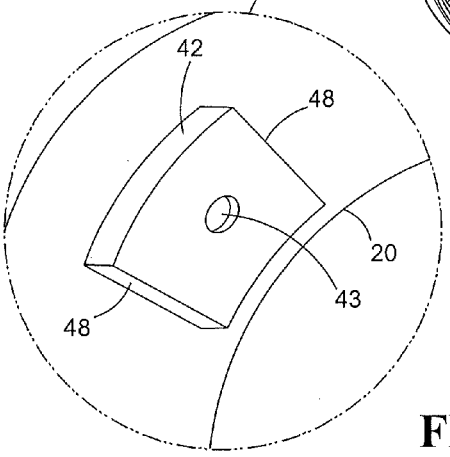
FIG. 1A is close up view of a portion of the reel of FIG. 1.
Figure 2:
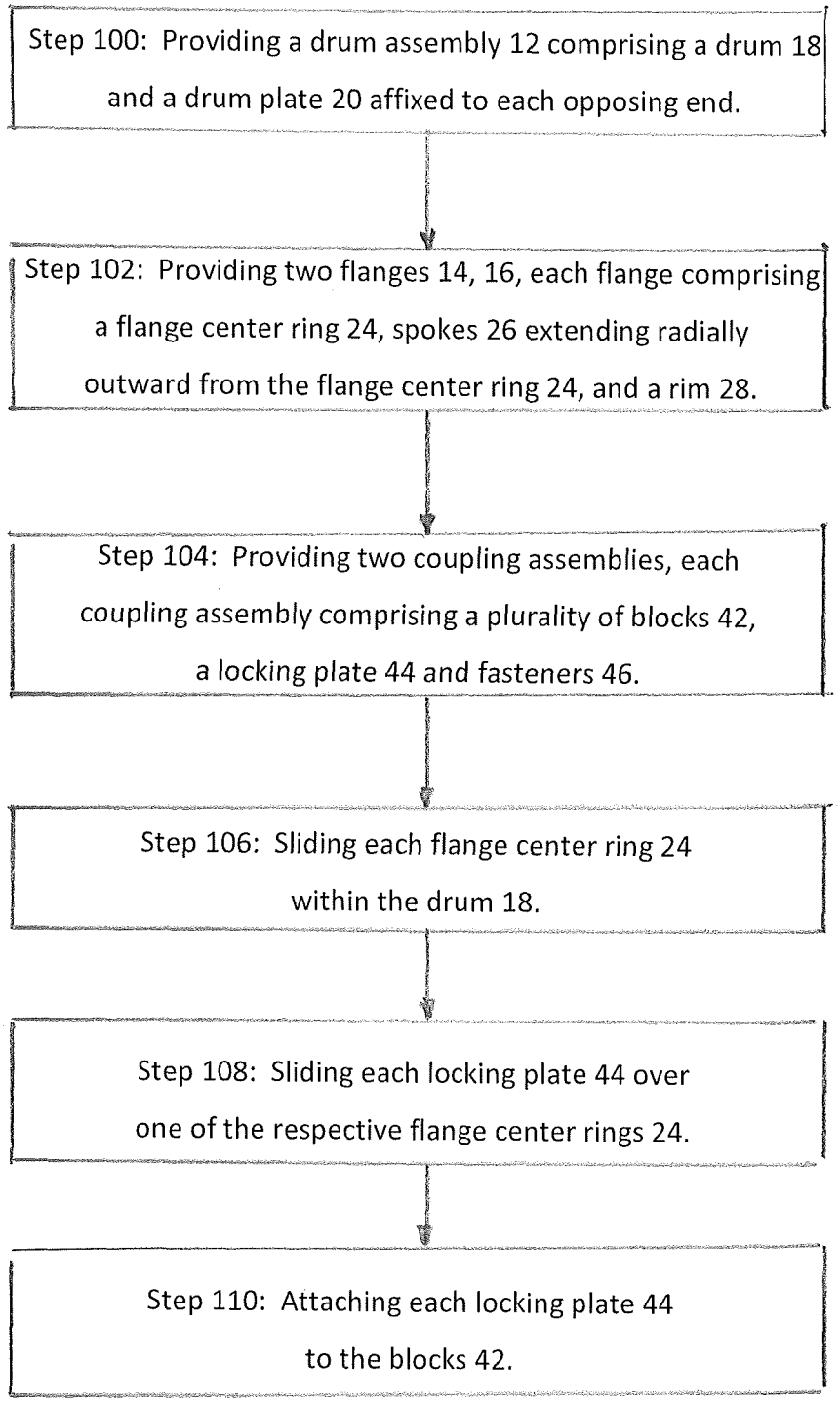
FIG. 2 is a flow chart showing a method of making a reel according to the invention.

As best shown in FIG. 1A, each block 42 may define a threaded bore 43 for receiving a fastener 46. Each block 42 may be wedged between a pair of adjacent spokes 26 in the assembled reel 10 to help prevent rotational movement of the flanges 14, 16 with respect to the drum assembly 12. For example and without limitation, each block 42 may be wedge shaped, that is, having outwardly facing, non-parallel, angular sides 48 that abut the spokes 26 in the assembled reel 10.

The locking plate 44 may define one or more spaced apart fastener openings 47 in substantial axial alignment with the threaded bores 43 and configured to receive the fasteners 46.

The collapsible reel 10 has a number of advantages over all-welded designs:

First, the new design is easy to break down and re-assemble.

Second, the new design allows the operator to break down the reel 10 and use interchangeable drums with the same flanges 14, 16. This allows the owner to purchase one set of flanges 14, 16 that can be used interchangeably with many different drum and traverse dimensions.

Third, the reel 10 can be broken down into smaller, space-saving dimensions for return shipping.

Fourth, the design allows more reels 10 to be loaded onto a shipping vessel than all-welded designs, thus maximizing payload.

In another aspect of the invention a method of assembling a reel 10 is provided. The method may comprise the following steps:

Step 100: Providing a drum assembly 12 comprising a substantially cylindrical drum 18 having an inner diameter and opposing ends and a drum plate 20 affixed to each opposing end and having a central opening 22 therein.

Step 102: Providing two flanges 14, 16, each flange comprising a substantially cylindrical flange center ring 24 having an outer diameter slightly smaller than the inner diameter of the central opening 22, spokes 26 extending radially outward from the flange center ring 24 and having distal ends, and a rim 28 affixed to the distal ends of the spokes 26.

Step 104: Providing two coupling assemblies 40, each coupling assembly comprising a plurality of circumferentially spaced apart blocks 42 affixed to the drum plate 20, a locking plate 44 and fasteners 46.

Step 106: Sliding each flange center ring 24 within the drum 18 so that each block 42 fits between adjacent spokes 26.

Step 108: Sliding each locking plate 44 over one of the respective flange center rings 24 until the locking plate abuts the spokes 26.

Step 110: Attaching each locking plate 44 to the plurality of blocks 42 using the fasteners 46 so that each flange 14, 16 is captured between a drum plate 20 and a locking plate 44.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A reel comprising:

a drum assembly comprising a drum having an inner diameter and configured to receive wound product, the drum having opposing ends, the drum assembly also comprising a drum plate affixed to each end and having a central opening therein;

a first flange comprising a flange center ring having a diameter slightly smaller than the inner diameter of the drum so that the flange center ring can slide within the drum, spokes extending radially outward from the flange center ring and having distal ends, and a rim affixed to the distal ends of the spokes;

a second flange comprising a flange center ring having a diameter slightly smaller than the inner diameter of the drum so that the flange center ring can slide within the drum, spokes extending radially outward from the flange center ring and having distal ends, and a rim affixed to the distal ends of the spokes; and two coupling assemblies, one for removably affixing each flange to the drum assembly, wherein each coupling assembly comprises at least one block affixed to the drum plate and sized to fit between adjacent spokes, a locking plate that fits over the flange center ring, and fasteners that affix the locking plate to each of the at least one block.

2. The reel of claim 1 wherein:

the number of blocks is at least two and the blocks are substantially equally circumferentially spaced apart on the drum plate.

3. The reel of claim 2 wherein:

the number of blocks is three.

4. The reel of claim 3 wherein:

the blocks are welded to the drum plate.

5. The reel of claim 2 wherein:

each block defines a threaded bore;

each locking plate defines fastener openings in substantial axial alignment with the threaded bores and configured to receive the fasteners.

6. The reel of claim 5 wherein:

the fasteners are bolts.

7. The reel of claim 5 wherein:

each block is wedged between a pair of adjacent spokes to help prevent rotational movement of the flanges with respect to the drum assembly.

8. The reel of claim 5 wherein:

each block is wedge shaped.

9. The reel of claim 5 wherein:

each block has non-parallel angular sides that abut the spokes.

10. A method of assembling a reel comprising the following steps:

Providing a drum assembly comprising a substantially cylindrical drum having an inner diameter and opposing ends and a drum plate affixed to each opposing end and having a central opening therein;

Providing two flanges each flange comprising a substantially cylindrical flange center ring having an outer diameter slightly smaller than the inner diameter of the central opening, spokes extending radially outward from the flange center ring and having distal ends, and a rim affixed to the distal ends of the spokes;

Providing two coupling assemblies, each coupling assembly comprising a plurality of circumferentially spaced apart blocks affixed to one of the respective drum plates, a locking plate and fasteners;

Sliding each flange center ring within the drum so that each block fits between adjacent spokes;

Sliding each locking plate over one of the respective flange center rings until the locking plate abuts the spokes; and Attaching each locking plate to the plurality of blocks using the fasteners.

* * * * *